US005522701A

United States Patent [19]

Nicklas et al.

[11] Patent Number: 5,522,701

[45] Date of Patent: Jun. 4, 1996

[54] VERTICAL BARREL PUMP

[75] Inventors: Alexander Nicklas, Dirmstein; Jürgen Schill, Weisenheim, both of Germany

[73] Assignee: KSB Aktiengesellschaft, Frankenthal, Germany

[21] Appl. No.: 220,099

[22] Filed: Mar. 30, 1994

[30] Foreign Application Priority Data

Mar. 31, 1993 [DE] Germany ..... 43 10 467.3

[51] Int. Cl.[6] ..... F04D 1/06

[52] U.S. Cl. ..... 415/199.1; 415/199.2

[58] Field of Search ..... 415/199.1, 199.2, 415/211.1

[56] References Cited

U.S. PATENT DOCUMENTS

| | | | |
|---|---|---|---|
| 2,161,695 | 6/1939 | Bigelow . | |
| 3,370,542 | 2/1968 | Harney . | |
| 3,689,931 | 9/1972 | Fortis | 415/214.1 |
| 4,076,450 | 2/1978 | Ross . | |
| 4,778,334 | 10/1988 | Medgyesy et al. | 415/199.1 |
| 4,893,986 | 1/1990 | Catterfeld . | |
| 5,076,758 | 12/1991 | Palgrave . | |
| 5,180,280 | 1/1993 | Honda . | |

FOREIGN PATENT DOCUMENTS

| | | |
|---|---|---|
| 21571 | 10/1956 | Germany . |
| 2614163 | 4/1976 | Germany . |
| 3011888A1 | 3/1980 | Germany . |
| 4041545C2 | 12/1990 | Germany . |
| 526732 | 3/1940 | United Kingdom . |

*Primary Examiner*—John T. Kwon
*Attorney, Agent, or Firm*—Darby & Darby

[57] ABSTRACT

The invention relates to a vertical barrel pump, in which components, constructed as separate inserts in the form of a guide wheel insert, a radially and/or axially developed spiral insert and a diffuser-shaped pressure connecting piece insert are disposed in the region of the last pump stage to improve the efficiency of the multi-stage pump.

6 Claims, 4 Drawing Sheets

VERTICAL BARREL PUMP

FIELD OF THE INVENTION

The present invention relates to a centrifugal pump. More specifically, the present invention relates to a centrifugal pump having a guide wheel insert, a spiral insert and a diffuser shaped pressure connection piece disposed within the most downstream vertical barrel housing of a multi-stage centrifugal pump.

BACKGROUND OF THE INVENTION

Centrifugal pump constructions, of the type known as double housing pumps, shell pumps and/or barrel-type pumps, are surrounded by a barrel-like housing. The barrel, provided with suction and pressure connection pieces, is closed off tightly with a cover in a plane perpendicular to the shaft. The drive shaft passes through the cover as well as through a shaft seal. The advantage of constructing the housing in this way is that the barrel can remain connected to the pipelines and foundation when the pump is disassembled. These pumps are usually multi-stage pumps and are used for high and very high pressures, particularly as a boiler feed pump. A forged housing, which has the highest resistance to pressure, can be used as the barrel. To operate a pump of this construction with the best possible efficiency, it is necessary to coordinate the impellers or wheels and the subsequent guide wheels very precisely for each particular application, thus requiring a considerable expenditure for design and manufacture for each application.

It is an object of the present invention to develop a construction for such pump housings that is improved in efficiency and is adaptable to numerous different installations.

SUMMARY OF THE INVENTION

One embodiment of the present invention provides a radially and/or axially developed spiral which is a component of the housing cover and/or the last or downstream most stepped housing. A spiral shape, which develops initially in the radial direction and then in the axial direction, has also proven to be advantageous. If more space is available, other directions for developing the spiral are possible. Accordingly, in an advantageous manner, enlargement of the barrel can be avoided and the previously available annular space, in which the pumping medium emerging from the centrifugal pump collects and is supplied to the pressure connection piece, can be used for efficiency-improving measures. By appropriately configuring the cover that closes off the barrel and using it as a performance-increasing, flow-guiding component, it is possible to keep the overall size of the pump constant.

A further embodiment of the present invention provides that the spiral insert, when viewed in the flow direction is disposed after or downstream of the guide wheel insert. As a result, the possibility exists of having to adapt only the guide wheel insert to face the wider wheel, within a desired region of the wheel. Alterations or adaptations to the spiral insert can thus be omitted completely. It is also possible, depending on the factors for which the pump is being used, to construct the guide wheel insert itself without blades and to provide it with a circular diffuser from which the fluid transfers into the spiral insert.

Another embodiment of the present invention provides a diffuser-shaped pressure connection piece insert that can be inserted in the pressure connection piece from the interior of the housing to provide a reliable mounting of the insert and sealing of the insert easy to achieve. Accordingly, the insert lies directly against the vertical barrel, for example, with a protruding collar. Moreover, the advantage arises that the diffuser-shaped insert can be manufactured from a particularly resistant material, in order to be able to resist the high flow velocities in the region of the last pump stage. The vertical barrel itself can be manufactured from a more favorably priced material, which is provided with an appropriate metal coating in the region of the surfaces guiding the liquid, in order to improve the wear resistance.

Practical experiments have shown that the efficiency of the last pump stage can be improved by 3 to 4% with the construction of the present invention. Thus, a clear improvement in the overall efficiency, even in the case of pump constructions with up to six stages, is possible so that a more rapid amortization of the pump becomes possible with the help of the savings in energy costs. The construction of the present invention, in the form of inserts, enables the pump to be adapted easily to the existing installation by a combination of different inserts.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENTS

Figure 1:
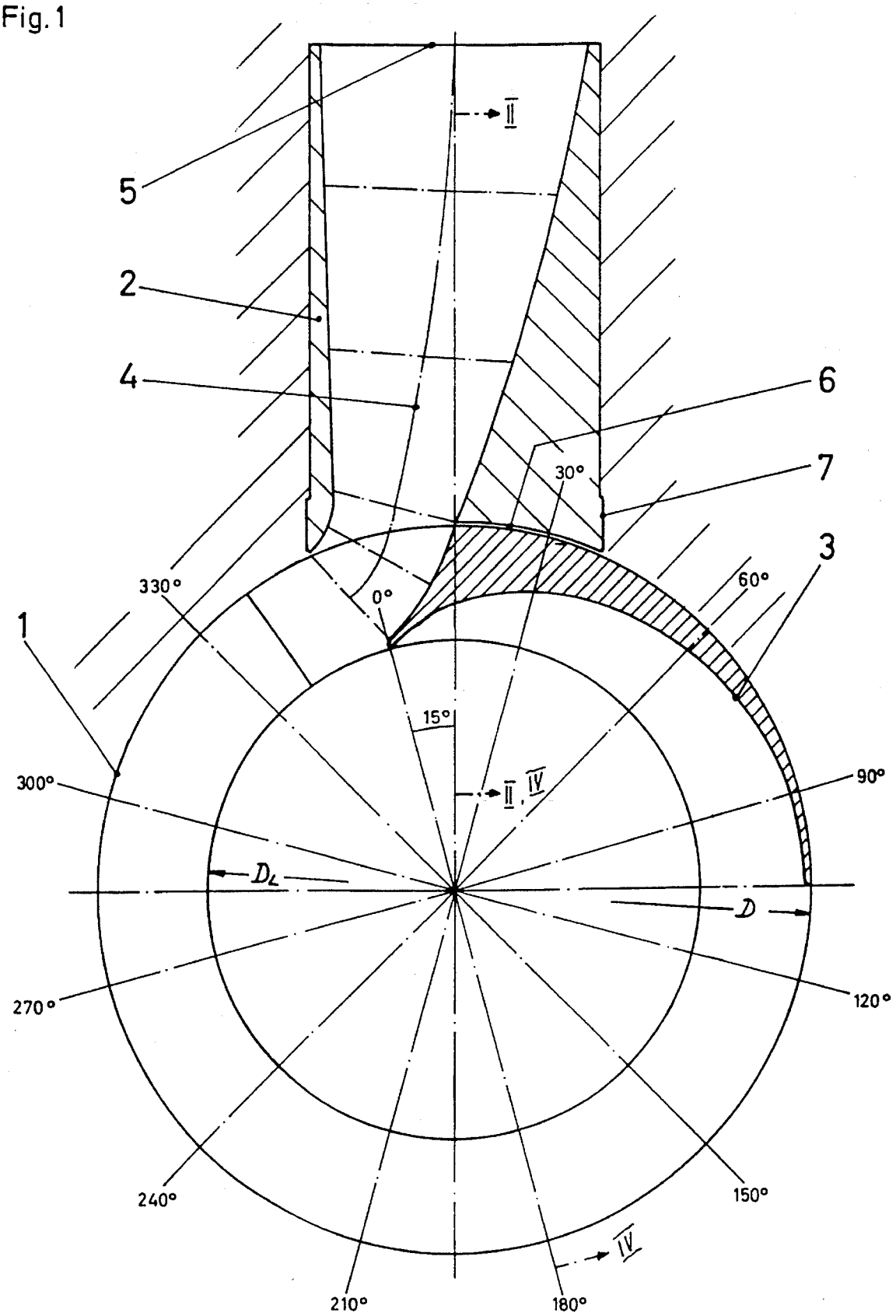
FIG. 1 shows a cross section through the pressure connection piece insert and the spiral insert.

Referring now to FIG. 1, a meridian section through a spiral insert 1 with a downstream diffuser insert 2 is illustrated. For reasons of greater clarity, the guide wheel insert 13 has not been shown in this Figure. From the start (i.e., 0°), the spiral 3 in the spiral insert 1 expands over about 100° to its maximum diameter D. Spiral 3 then expands in a cross-section in the axial direction at constant diameter. In the transition region from the spiral insert 1 to the pressure connection piece insert 2, spiral insert 2 has its largest cross-sectional area. Spiral 3 commences in the region of the guide wheel outlet diameter $D_L$.

The pressure connection piece insert 2 has disposed in its interior a diffuser-shaped expansion area 4, which largely corresponds in the region of outlet 5 to the cross section of a pressure line, which is to be connected thereto. The surface 6, of the diffuser insert 2, facing the spiral insert 1, has a cylindrical groove so that a good fit with the spiral insert 1 is made possible. A protruding collar 7 holds the diffusion insert 2 within the vertical barrel 8, which is indicated in this figure merely by crosshatching.

Figure 2:
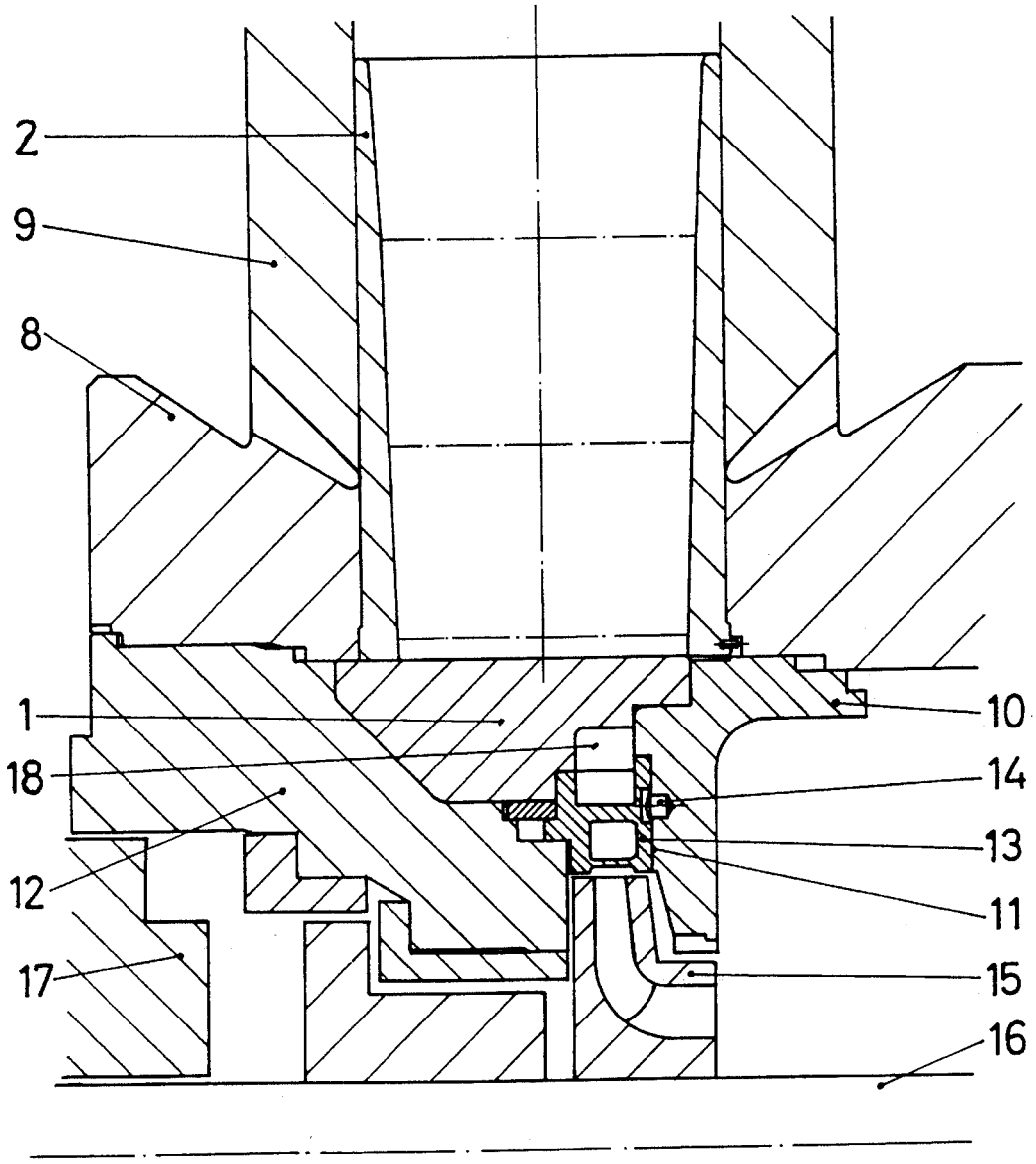
FIG. 2 shows a longitudinal section through the pump housing in the region of the last pump stage.

FIG. 2 shows a section along the line II—II of FIG. 1, corresponding to a longitudinal section through a vertical barrel 8 in the region of the last step of the multi-stage pump. It can be seen here that a diffuser insert 2 has been pushed from the interior of the pump into the barrel housing 8 into the pressure connection piece 9. A last stepped housing 10, pushed into the vertical barrel 8 from outside, holds the diffuser insert 2 in place. A guide wheel insert 13 is disposed between an end face 11 of the last stepped housing 10 and a cover 12, closing off the vertical barrel 8. Guide wheel insert 13 is held in place by rotation-preventing elements 14. The last impeller wheel 15 is disposed on a shaft 16, which is held by a seal housing and a bearing box generally indicated by reference numeral 17 within the cover 12. An efficiency-increasing adaptation to the respective installation conditions can be brought about very simply by an appropriate combination of guide wheel inserts, stepped housing inserts and spiral inserts, as well as wheels. The spiral insert 1, which was constructed here as an independent component, can also be an integral component of the cover 12 closing off the vertical barrel 8. The same holds true for the guide wheel insert 13. It is also readily possible to transfer the function of the spiral insert and/or of the guide wheel insert 13 to the last stepped housing part 10.

Figure 3:
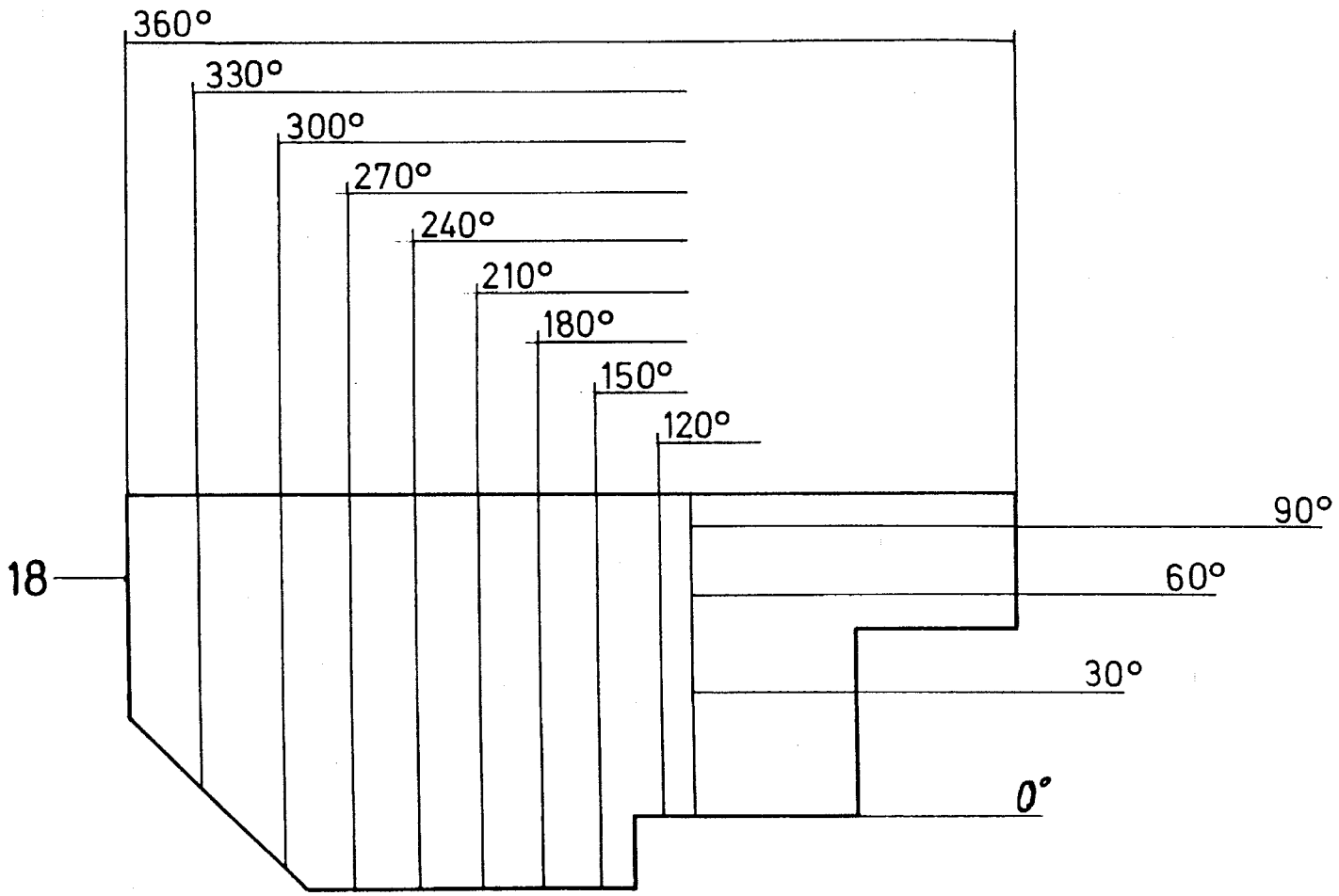
FIG. 3 shows a representation of the development of the spiral insert.

The individual cross sectional enlargements of the spirals are shown in the illustrative representation of FIG. 3. The area, bordered by a heavy line, corresponds to a free spiral cross section 18 at a 360° looping angle, that is at the spiral outlet. The thin lines, disposed within this area, have been given degree numbers and reproduce the spiral cross section, which is marked with identical degree numbers in FIG. 1. In the region starting with a spiral looping angle of about 100°, the spiral has a constant outer diameter. The spiral cross section then changes only laterally in the axial direction and optionally also radially inward.

Figure 4:
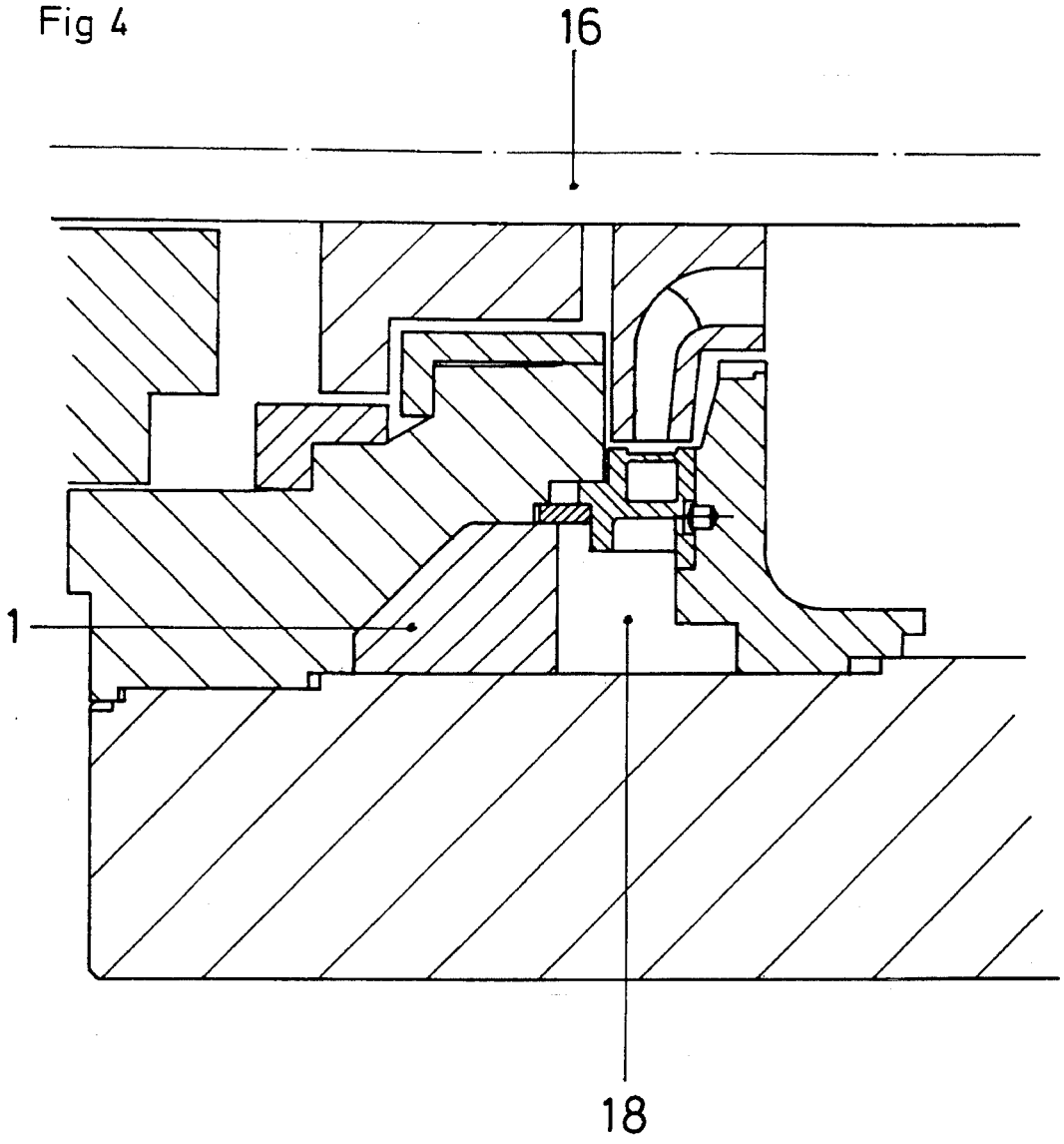
FIG. 4 shows a cross section through the spiral insert at about 180° of spiral development.

FIG. 4 shows a section corresponding to line IV—IV of FIG. 1 through the last stage of the pump at a looping angle of about 180°. The cross section 18 of the spiral corresponds to that of FIG. 3 at a spiral looping angle of 180°.

From the foregoing description, it will be appreciated that the present invention makes available, a compact, cost efficient multi-stage centrifugal pump.

Having described the presently preferred exemplary embodiment of a new and improved multi-stage centrifugal pump in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. A multi-stage centrifugal pump comprising:

a barrel housing;

a plurality of impellers being disposed within said barrel housing;

a plurality of flow-guiding stepped housings being disposed between said plurality of impellers;

a guide wheel insert disposed adjacent to the downstream most impeller;

a radially and axially expanding spiral insert disposed adjacent to said guide wheel insert; and a diffuser-shaped pressure connecting piece insert being disposed within the barrel housing in the region of the downstream most stepped housing adjacent to said spiral insert.

2. The centrifugal pump of claim 1, wherein said spiral insert is a component of a housing cover.

3. The centrifugal pump of claim 1, wherein said spiral insert is disposed, when viewed in the flow direction, after the guide wheel insert.

4. The centrifugal pump of claim 2, wherein said spiral insert is disposed, when viewed in the flow direction, after the guide wheel insert.

5. The centrifugal pump of claim 4, wherein said diffuser-shaped pressure connection piece insert is inserted from the interior of said barrel housing into a pressure connecting piece that is connected to said barrel housing.

6. The centrifugal pump of claim 5, wherein said guide wheel insert is devoid of blades.

* * * * *